US011566455B2

(12) United States Patent
Oberst et al.

(10) Patent No.: US 11,566,455 B2
(45) Date of Patent: Jan. 31, 2023

(54) SIGNAL GENERATOR FOR A VEHICLE DOOR

(71) Applicant: ILLINOIS TOOL WORKS INC., Glenview, IL (US)

(72) Inventors: Joachim Oberst, Grossrinderfeld (DE); Stefan Zöller, Mönchberg (DE); Elmar Fries, Röttingen (DE); Zsolt Wilke, Bad Mergentheim (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/286,836

(22) PCT Filed: Oct. 22, 2019

(86) PCT No.: PCT/US2019/057307
§ 371 (c)(1),
(2) Date: Apr. 20, 2021

(87) PCT Pub. No.: WO2020/086501
PCT Pub. Date: Apr. 30, 2020

(65) Prior Publication Data

US 2021/0340793 A1 Nov. 4, 2021

(30) Foreign Application Priority Data

Oct. 25, 2018 (DE) ..... 10 2018 126 686.3

(51) Int. Cl.
*E05B 81/76* (2014.01)
*H01H 1/58* (2006.01)
*H01H 13/04* (2006.01)

(52) U.S. Cl.
CPC ..... *E05B 81/76* (2013.01); *H01H 1/5866* (2013.01); *H01H 13/04* (2013.01)

(58) Field of Classification Search
CPC ..... H01H 13/00; H01H 13/04; H01H 1/58; H01H 1/5866; H01H 3/00; H01H 3/04;
(Continued)

(56) References Cited

U.S. PATENT DOCUMENTS 6,613,994 B2 * 9/2003 Bauer ..... H01H 13/48 200/512

FOREIGN PATENT DOCUMENTS

DE 102005034763 B3 9/2006
EP 1568053 B1 8/2005
(Continued)

OTHER PUBLICATIONS

PCT, International Search Report and Written Opinion, International Application No. PCT/US2019/057307; dated Feb. 14, 2020, 12 pages.

*Primary Examiner* — Anthony R Jimenez
(74) *Attorney, Agent, or Firm* — Thompson Hine LLP

(57) ABSTRACT

A signal generator, in particular opening switch, for a vehicle door or flap, including an actuator, in particular an actuator which can be manually actuated and/or gripped by an operating person, furthermore including a plug housing (14) with a switch (22) which is received therein or arranged thereon and which has electrical contacts (20) which form part of a plug connection, and including an actuator housing (12) with the actuator (30), the actuator being mounted movably on the actuator housing (12) and acting on the switch (22), the actuator housing (12) and the plug housing (14) being positionally fixed relative to one another, wherein the electrical contacts (20) are electrically connected to the switch (22) by plugged-in conductors.

20 Claims, 7 Drawing Sheets

(58) Field of Classification Search
CPC ..... H01H 9/06; H01H 13/10; H01H 13/186; H01H 21/00; H01H 21/22; H01H 25/00; H01H 2009/06; H01H 2009/066; H01H 2021/00; H01H 2021/22; H01H 2025/00; H01H 2221/00; H01H 2221/016; E05B 81/76; E05B 77/22; E05B 81/00; E05B 81/02; E05B 81/64; E05B 81/78; E05B 79/00; E05B 79/02; E05B 79/04; E05B 79/06; E05B 79/08; E05B 79/10
USPC ..... 200/293
See application file for complete search history.

(56) References Cited

FOREIGN PATENT DOCUMENTS

| | | | |
|---|---|---|---|
| EP | 1677324 | B1 | 7/2006 |
| EP | 2259279 | B1 | 12/2010 |
| EP | 2530692 | A1 | 12/2012 |
| WO | WO 2014148221 | A1 | 9/2014 |

* cited by examiner

SIGNAL GENERATOR FOR A VEHICLE DOOR

TECHNICAL FIELD

The invention relates to a signal generator, in particular an opening switch, for a vehicle door, comprising a plug housing with a switch which is received therein and which has electrical contacts which form part of a plug connection, and comprising an actuator housing with an actuator which is mounted movably on the actuator housing and which acts on the switch.

BACKGROUND

As opening switches, signal generators of the above-mentioned type can serve for the activation in particular of an electric drive which permits the automatic opening of a vehicle door. This may for example be a sliding door or a pivoting door. To open the vehicle door, the actuator, for example a door lever, is moved into an opening position by an operating person, and an electrical connection between the electrical contacts of the switch is thus closed by means of the switch. The switch is normally a microswitch in the case of known opening switches.

EP 1 677 324 B1 describes an opening switch and a method for producing an opening switch, wherein, firstly, in a low-pressure process, a microswitch and a connection part are connected to one another to form an intermediate body by virtue of a polymer being molded on. Subsequently, by means of injection molding, a cover is integrally formed onto the intermediate body, which cover is, as a lid, arranged in contact with the housing of an actuator. A seal may be provided between the cover and the actuator housing.

EP 2 259 279 B1 has disclosed an opening switch for a vehicle door, wherein an electrical unit having a switch is connected to a mechanical unit having an actuating element, and is encapsulated by means of a seal at the connecting point.

EP 1 568 053 B1 has disclosed an opening switch with a tilting actuator with resetting springs as actuating element. The tilting actuator acts on a switch on which a connecting part is integrally formed by injection molding. The connecting part is in turn connected by means of detent elements to a lid, which is connected by means of drivers to a body which has the tilting actuator.

SUMMARY

Proceeding from the prior art discussed, it is the object of the invention to provide a structurally more simple signal generator and/or a simpler method for the production thereof.

The invention achieves the object by means of a signal generator as per claim 1 and by means of a method for producing a signal generator as per claim 10. The subclaims, the description and the figures relate to advantageous embodiments.

The signal generator according to the invention for a vehicle door or flap comprises an actuator, in particular an actuator which can be manually actuated and/or gripped by an operating person, furthermore comprises a plug housing with a switch which is received therein or arranged thereon and which has electrical contacts which form part of a plug connection, and comprises an actuator housing with the actuator, the actuator being mounted movably, preferably movably about a pivot axis, on the actuator housing and acting on the switch, wherein the embodiment is preferably such that a pivoting movement of the actuator is converted into a switching of the switch, wherein the actuator housing and the plug housing are positionally fixed relative to one another, and the electrical contacts are electrically connected to the switch by means of plugged-in conductors.

Preferably, the plug housing and the actuator housing are formed integrally on one another, and the switch is inserted with the electrical contacts into the plug housing formed integrally on the actuator housing. Alternatively, the plug housing is fastened preferably by means of a detent connection to the actuator housing.

The method according to the invention for producing a signal generator which has a plug housing, with a switch which is received therein and which has electrical contacts which form a part of a plug connection, and an actuator housing, with an actuator which is mounted movably, preferably movably about a pivot axis, on the actuator housing and which acts on the switch, in particular an actuator which can be manually actuated and/or gripped by an operating person, wherein the embodiment is preferably such that a pivoting movement of the actuator is converted into a switching of the switch, comprises the steps:

- attaching the plug housing and the actuator housing to one another,
- inserting the switch with the electrical contacts into or onto the plug housing;
- electrically connecting the electrical contacts to the switch by plugging-in of conductors.

The attachment of the plug housing and of the actuator housing to one another is preferably performed by integral formation of the plug housing and of the actuator housing on one another.

The signal generator according to the invention is provided for generating an electrical signal in the region of a vehicle door, in particular in a manner triggered by a door opener as actuator. The door opener may for example be a door lever. For example, the signal generator may serve as an opening switch for the opening of a vehicle door. The signal generator may also control the lowering of a window in order to ensure, for example, the automatic lowering of a vehicle window in the event of the movement of the actuator. As mentioned in the introduction, it is for example possible for a sliding door or a pivoting door to be involved here. By virtue of the actuator being moved by an operating person, for example by a manual, preferably direct actuation of the actuator by the operating person, the switch is triggered and thus produces an electrical connection between the electrical contacts. An electric drive connected by means of the electrical contacts of the signal generator can thus be activated and thus performs a function; for example, the vehicle door can be opened. The switch may for example be a microswitch. The switch may also be formed by one or more in particular contactlessly triggering sensors, for example by a Hall sensor.

According to the invention, the electrical contacts are electrically connected to the switch by means of plugged-in conductors, whereby automatable installation is advantageously made possible.

The switch is received at least in certain portions, in particular with its contacts, in the plug-in housing. The switch may thus also at least partially project out of the plug housing. In its state inserted into the plug housing, the switch may for example be held on the plug housing by detent means. The electrical contacts may for example project from the switch and form the male part of the plug connection. A component to be connected to the plug housing, for example an electric drive, may correspondingly have a correspondingly designed female part of the plug connection. The electrical contacts of the switch may however basically also form the female part of a plug connection, wherein a component to be connected to the plug housing then correspondingly forms the male part of the plug connection. In both cases, it is thus preferable for only one conductor component (for example metal part) to be provided for each pole of the switch, which conductor component, at one end, directly forms (without further components) a contact point for the plug connection (to the wiring harness of the vehicle) and, at the other end, makes contact with the connection terminal of the switch.

In one embodiment, at least one of the contacts, preferably all contacts, is/are in one piece and, at one side, form(s) the contact for the plug connection and, at the other side, is/are plugged onto the switch by being plugged onto an output contact pin or an output contact lug which projects out of a housing in which the switch is received as a module. In a further method according to the invention, a correspondingly one-piece arrangement of the one or more contacts is realized.

In one embodiment, the switch has a clip structure, preferably in the form of a female part of a plug connection, in particular in the form of a slotted metal plate or two oppositely situated pins, as connection point, and at least one of the electrical contacts, preferably at a straight portion, preferably at an end portion of the electrical contact, is plugged into the clip structure. In a further method according to the invention, corresponding plugging of an end of at least one of the electrical contacts into a clip structure that the switch has as connection point is performed.

The production method is simplified as a result of the assignment of the clip structure to the switch. This is because the clip structure, which is relatively complex to produce, can then be manufactured as part of the switch, which is easier because the switch in any case rather constitutes a standard part, whereas the electrical contacts must be specially manufactured in a manner dependent on the geometry of the signal generator for a vehicle door or flap. Since the contacts however only need to have a single region which can then be plugged into the clip structure, these are also easy to produce.

According to the invention, the plug housing and the actuator housing are attached to one another, preferably formed integrally on one another, and, furthermore, the switch is inserted with the electrical contacts into the plug housing formed integrally on the actuator housing. The plug housing is thus formed directly on the actuator housing, for example by injection molding. Here, the integral formation of the plant housing and of the actuator housing on one another is to be understood not only to mean the formation of the plug housing—for example by injection molding—on the already manufactured actuator housing or the formation of the actuator housing—for example by injection molding—on the already manufactured plug housing, but also joint production of the plug housing with the actuator housing as one piece, as will be discussed in more detail further below.

Following the attachment, preferably integral formation, of the plug housing and of the actuator housing to or on one another, the switch is inserted into the plug housing. The switch may be inserted together with its electrical contacts into the plug housing. It is also possible, for example, for firstly the electrical contacts and subsequently the switch to be inserted. In particular, the electrical contacts may, as an alternative to separately plugged-in conductors, be formed on the switch. After the insertion of the switch or of the electrical contacts, the plug housing can be closed by means of a lid. As mentioned, the switch is inserted at least in certain portions into the plug housing, in particular such that the electrical contacts of the switch are situated within the plug housing. According to the invention, provision is thus preferably made whereby the plug housing and the actuator housing are integrally formed on one another, and the switch, the electrical contacts and possibly further components that are expedient for the function of the signal generator are only subsequently inserted into the plug housing. The production of the signal generator can thus be greatly simplified. The known prior art always provides separate production of plug housing and actuator housing and/or use of cables, wherein the two housings are subsequently connected to one another for example by adhesive or detent means. Here, it is commonly the case that the switch, the electrical contacts and possibly further components are already inserted or injection-molded into the plug housing before the connection of the plug housing to the actuator housing, as discussed in the introduction. Such production is not only more cumbersome but also leads to a less secure connection between plug housing and actuator housing. In one embodiment, the plug housing and the actuator housing are formed integrally on one another by injection molding. Correspondingly, the method may provide the step of integrally forming the plug housing and the actuator housing on one another by injection molding. By means of an injection molding process, the integral formation can be performed particularly easily, efficiently and reliably. The plug housing and the actuator housing may in particular be produced from the same plastic. In one embodiment, the actuator housing is firstly produced, and the plug housing is subsequently integrally formed on the plug housing. Correspondingly, the method may comprise the step of producing the actuator housing and subsequently integrally forming the plug housing onto the actuator housing. In this embodiment, it is consequently possible for the actuator housing to firstly be manufactured, in particular by injection molding. The plug housing can subsequently be formed integrally on the actuator housing, likewise in particular by injection molding. In an alternative embodiment, the plug housing is firstly produced, and the actuator housing is subsequently formed integrally on the plug housing. Correspondingly, the method may comprise the step of producing the plug housing and subsequently integrally forming the actuator housing on the plug housing. Such production can be technically simpler, because fewer complex injection-molding tools are required. In an alternative embodiment, the plug housing and the actuator housing are formed integrally on one another by means of joint production of plug housing and actuator housing as one piece. The method may consequently comprise the step of integrally forming the plug housing and the actuator housing on one another by means of joint production of plug housing and actuator housing as one piece. In particular, the plug housing and the actuator housing may be produced jointly as one piece by injection molding. Although it may be necessary for this purpose to initially create a relatively complex injection-molding tool, the subsequent production of the two housings as one piece is however then particularly simple and efficient. As already mentioned in the introduction, such production as one piece is in the present case also understood as integral formation of the plug housing and of the actuator housing on one another. By means of such integral formation, a simple and secure connection between plug housing and actuator housing is realized. By means of the arrangement of the electrical contacts within the plug housing directly on the actuator housing, it is furthermore possible to dispense with further cables, in particular a wiring harness. Also, in this way, it is made possible for a component to be activated by the signal generator to be arranged directly on the plug housing and thus on the actuator housing, as will be discussed in more detail further below.

In one embodiment, the signal generator has a carrier element on which the switch and/or the electrical contacts are electrically connected to the switch by means of plugged-in conductors are installed, the carrier element being arranged in or on the plug housing. In a further method according to the invention, the switch and the electrical contacts are pre-installed on a carrier element, and the carrier element is then arranged in or on the plug housing.

In this way, the production method is simplified, because the machine that installs the switches and the electrical contacts onto the carrier element no longer has to be adapted to the different actuator housing. It is preferable for multiple switches to be pre-installed onto the carrier element, such that different functions of the signal transducer can be covered. The plug housing is preferably formed by the carrier element, wherein, in this case, the plug housing is then attached to the actuator housing at a later point in time by means of a detent connection.

In one embodiment, a potting compound is introduced for the purposes of sealing the switch in the plug housing. The method may consequently comprise the step of introducing a potting compound into the plug housing for the purposes of stealing the switch in the plug housing. Here, the potting compound seals the switch at least in certain portions in the plug housing. It is also possible here for the potting compound to serve for fixing the switch, in particular together with the electrical contacts, in the plug housing. In particular, the electrical contacts of the switch are sealed by means of the potting compound. In particular, a receiving portion, which receives the switch and/or the electrical contacts, of the plug housing may be completely filled with potting compound. If the electrical contacts form the male part of the plug connection, the contacts may—aside from portions which are to be connected to the female part of the plug connection, for example of an electric drive—be received entirely in the potting compound. The potting compound may in particular replace a lid which closes off the plug housing at least in certain portions. This further simplifies the production process, and leads to an even more secure connection.

In one embodiment, the electrical contacts are formed by a lead frame. For the method, provision may be made whereby the electrical contacts are formed by a lead frame, the lead frame being severed to form separate electrical contacts after the insertion of the lead frame into the plug housing. Alternatively, the contacts may also be unconnected and inserted individually into the plug housing. The lead frame may be inserted together with the switch into the plug housing. The lead frame may also be inserted into the plug housing before or after the insertion of the switch. The lead frame permits simple production of the electrical contacts that form in particular the male part of the plug connection.

In one embodiment, the plug connection is designed for direct connection to an electric drive. A system may be provided which is composed of an electric drive and of a signal generator according to the invention, wherein the electric drive is connected directly to the plug housing. Correspondingly, the method may provide, in particular as a final step, the docking of the electric drive to the plug housing. Here, the electric drive enters into a connection with the electrical contacts arranged in the plug housing. As already mentioned in the introduction, the electrical contacts of the plug housing of the signal generator and correspondingly designed contacts of the electric drive thus form the plug connection. In particular, the electrical contacts of the plug housing may form the male part and the contacts of the electrical drive may form the female part of the plug connection. Since the switch is inserted with the electrical contacts into the plug housing, the connection to the electric drive can be realized directly. Here, directly means that the discussed plug connection is formed in particular without additional cables running between the electric drive and the plug housing. The electric drive can thus be easily attached to or mounted on the plug housing according to the invention. In particular, a formation of the electrical contacts by means of the lead frame is advantageous here. It is thus possible in particular to dispense with further cables and for the direct arrangement of the electric drive on the plug housing to be made possible.

BRIEF DESCRIPTION OF THE DRAWINGS

An embodiment of the invention will be discussed below on the basis of figures, in which.

Unless stated otherwise below, the same reference designations are used to denote the same objects.

DETAILED DESCRIPTION

Figure 1:
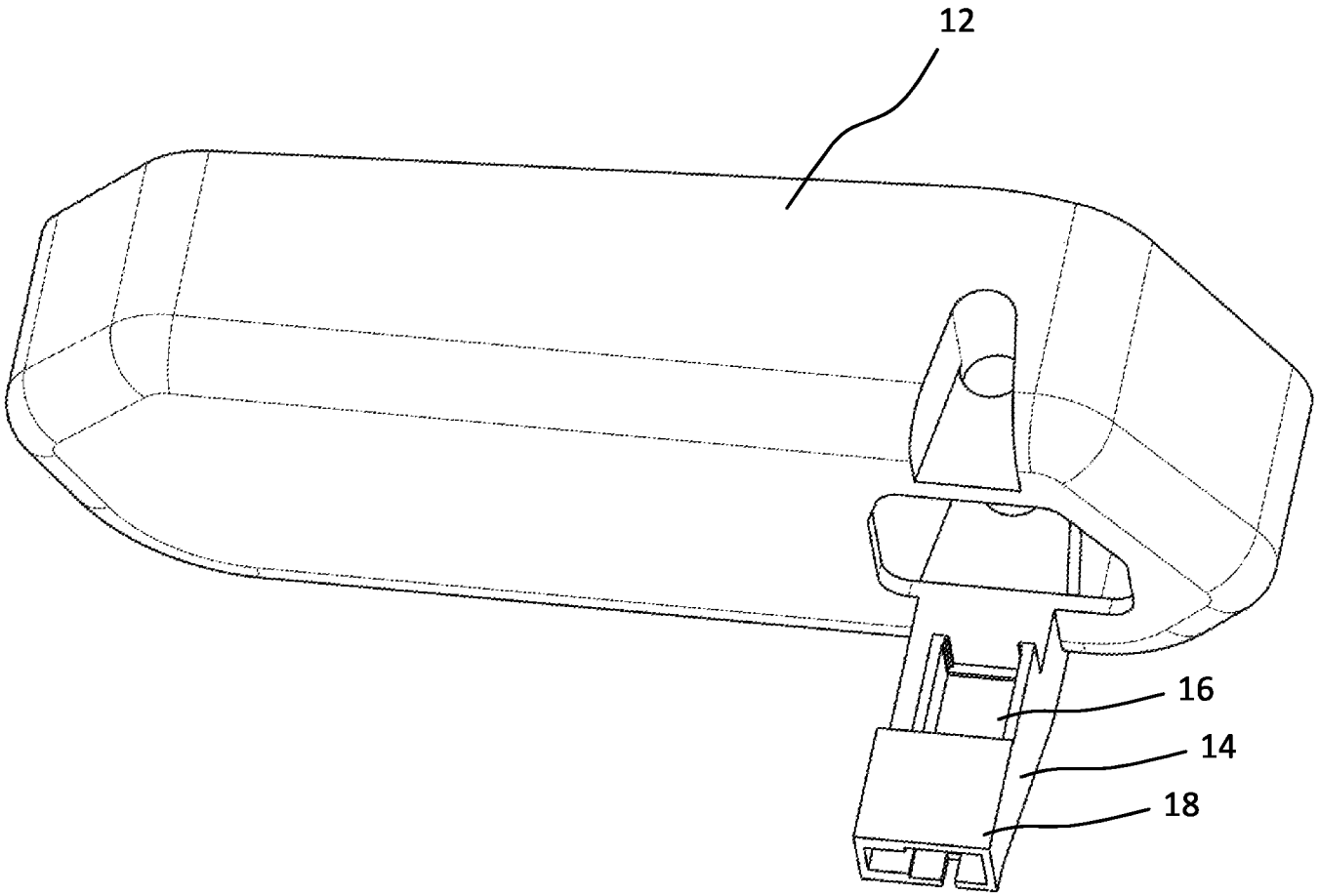
FIG. 1 shows an actuator housing with a plug housing, formed integrally thereon, of a signal generator according to the invention.
Figure 3:
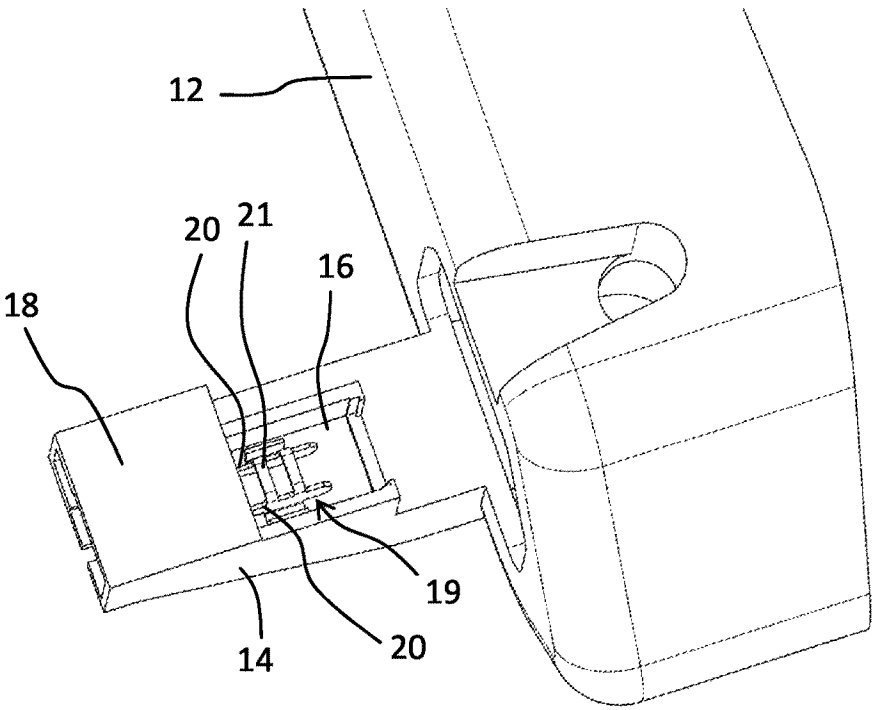
FIG. 3 shows the view from FIG. 2 with a lead frame inserted into the plug housing.

FIG. 1 shows an actuator housing 12 with a plug housing 14, formed thereon, of a signal generator according to the invention. The plug housing 14 comprises a receiving portion 16, for receiving a switch 22 with electrical contacts 20, and comprises a connecting portion 18, into which the electrical contacts project for the connection to an electric drive, for example, as will be discussed in more detail further below. The plug housing 14 may be formed on the actuator housing 12 in particular in an injection molding process. Likewise, the actuator housing 12 may be formed on the plug housing 14. This may be performed after production of the actuator housing 12 and subsequent integral formation of the plug housing 14 or after production of the plug housing 14 and subsequent integral formation of the actuator housing 12, or by means of joint manufacture of the actuator housing 12 with the plug housing 14 as one piece, in particular by injection molding.

Figure 2:
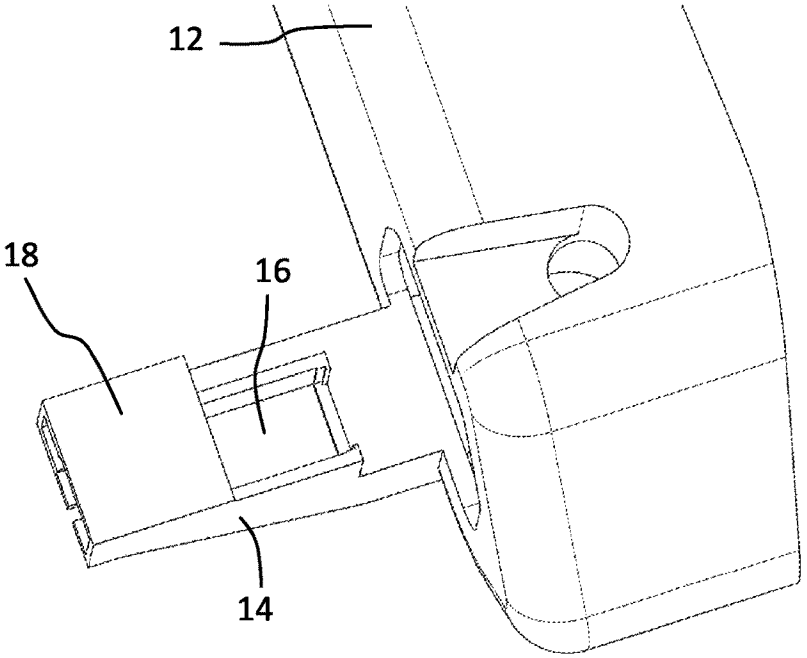
FIG. 2 shows the illustration from FIG. 1 in a view obliquely from above.
Figure 4:
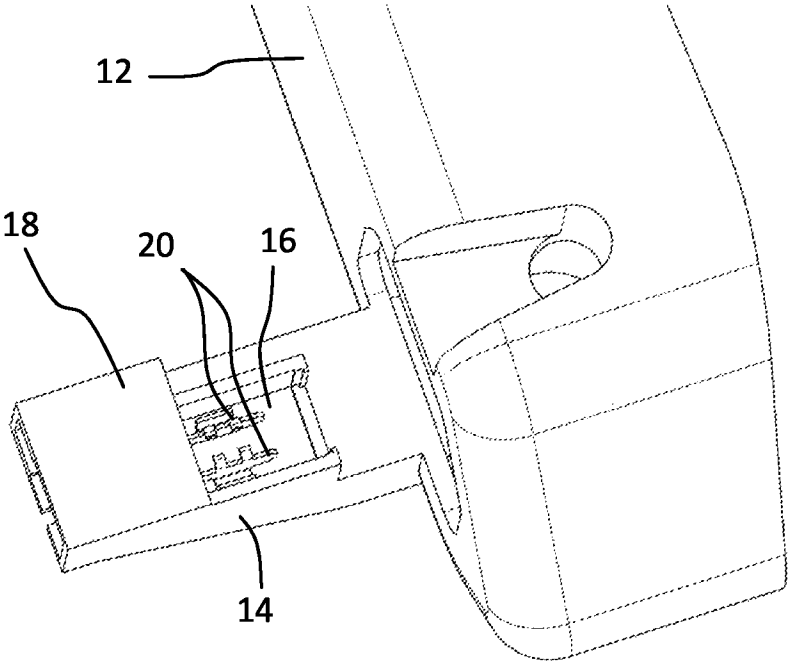
FIG. 4 shows the illustration from FIG. 3 with electrical contacts produced by severing of the lead frame.

The illustration in FIG. 2 likewise shows the unit, which can be seen in FIG. 1, composed of plug housing 14 and actuator housing 12, but only in certain portions and in a different plan view. The further production of the signal generator will be described below with reference to FIGS. 3 to 7. In the present embodiment of the method, after the integral formation of the plug housing 14 and of the actuator housing 12 on one another, a lead frame 19 composed of metal is firstly inserted into the receiving portion 16 of the plug housing 14. The lead frame 19 has the two electrical contacts 20, which are however still connected to one another by transverse webs 21. The lead frame 19 is inserted into the receiving portion 16 of the plug housing 14 such that the electrical contacts 20 project into the connecting portion 18 (visible in FIG. 10). In a subsequent production step, which can be seen in FIG. 4, the transverse webs 21 are severed, and the separate electrical contacts 20 are thus produced.

Figure 5:
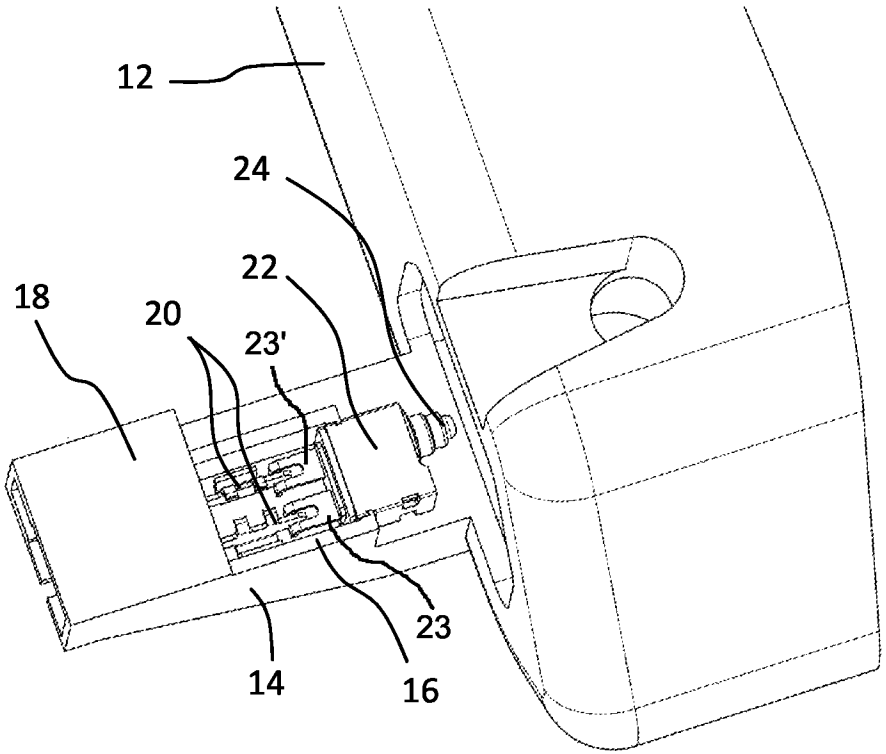
FIG. 5 shows the illustration from FIG. 4 with a switch inserted into the plug housing.

Subsequently, the switch 22 is inserted into the receiving portion 16 of the plug housing 14, as can be seen in FIG. 5. Here, the switch 22 projects in particular with a triggering element 24 out of the receiving portion 16. At least the electrical contacts 20 of the switch 22 are however received entirely in the plug housing 14, one part in the receiving portion 16 and the other part in the connecting portion 18. The electrical contacts 20 are electrically connected to the switch 22 by means of plugged-in conductors. The contacts 20 are in each case in one piece and, firstly, form the contact for the plug connection and, secondly, are plugged onto the switch 22 by being plugged in each case onto an output contact lug 23, which projects out of a housing in which the switch 22 is received as a module. The switch 22 has in each case one clip structure 23.1 at these connection points 23, and the electrical contacts 20 are plugged into the respective clip structure 23.1.

Secondly, a door lever 30 as actuator is inserted into the actuator housing 12. The door lever 30 is mounted in the actuator housing 12 so as to be pivotable about an axis of rotation D, and acts on the switch 22 in a manner to be discussed in more detail further below. The door lever 30 can be clearly seen in particular in FIG. 9.

Figure 7:
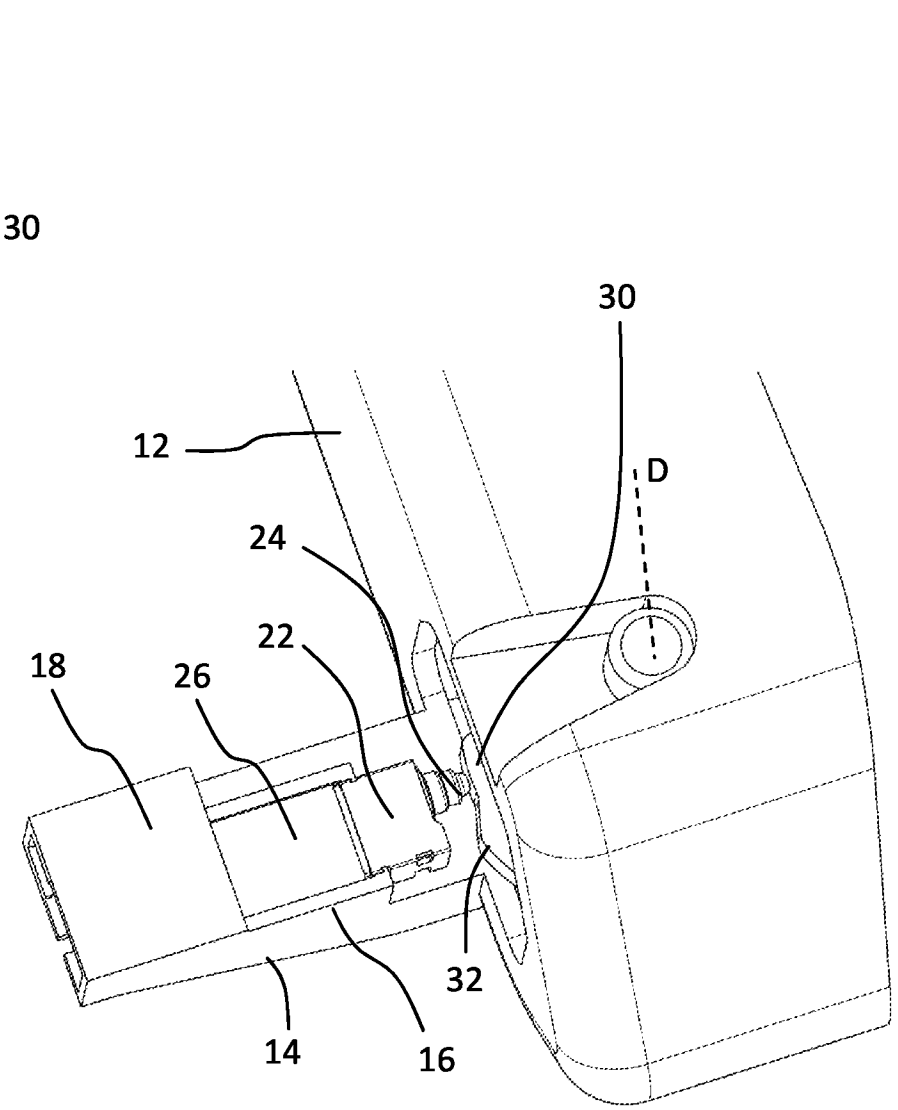
FIG. 7 shows the illustration from FIG. 6 with potting compound introduced into a receiving portion of the plug housing.

Finally, the receiving portion 16 of the plug housing 14 is filled with a potting compound 26, as can be seen in FIG. 7. The contacts 20 of the switch 22 are thus fixed and sealed in the plug housing 14. In particular, the potting compound does not ingress here into the connecting portion 18. By means of such a potting compound, it is furthermore possible to omit a lid that closes off the receiving portion 16.

Figure 6:
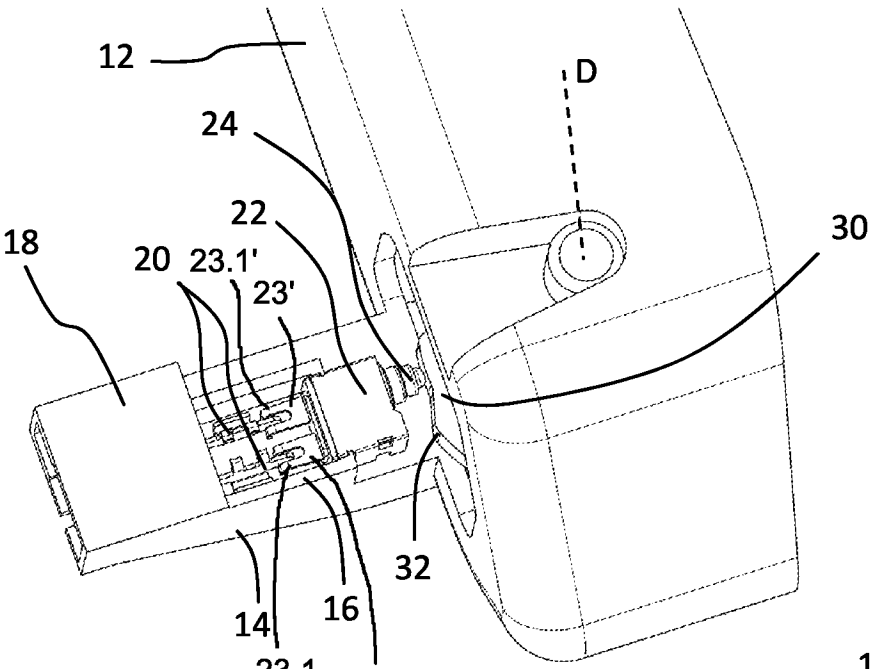
FIG. 6 shows the illustration from FIG. 5 with a door lever inserted into the actuator housing.
Figure 8:
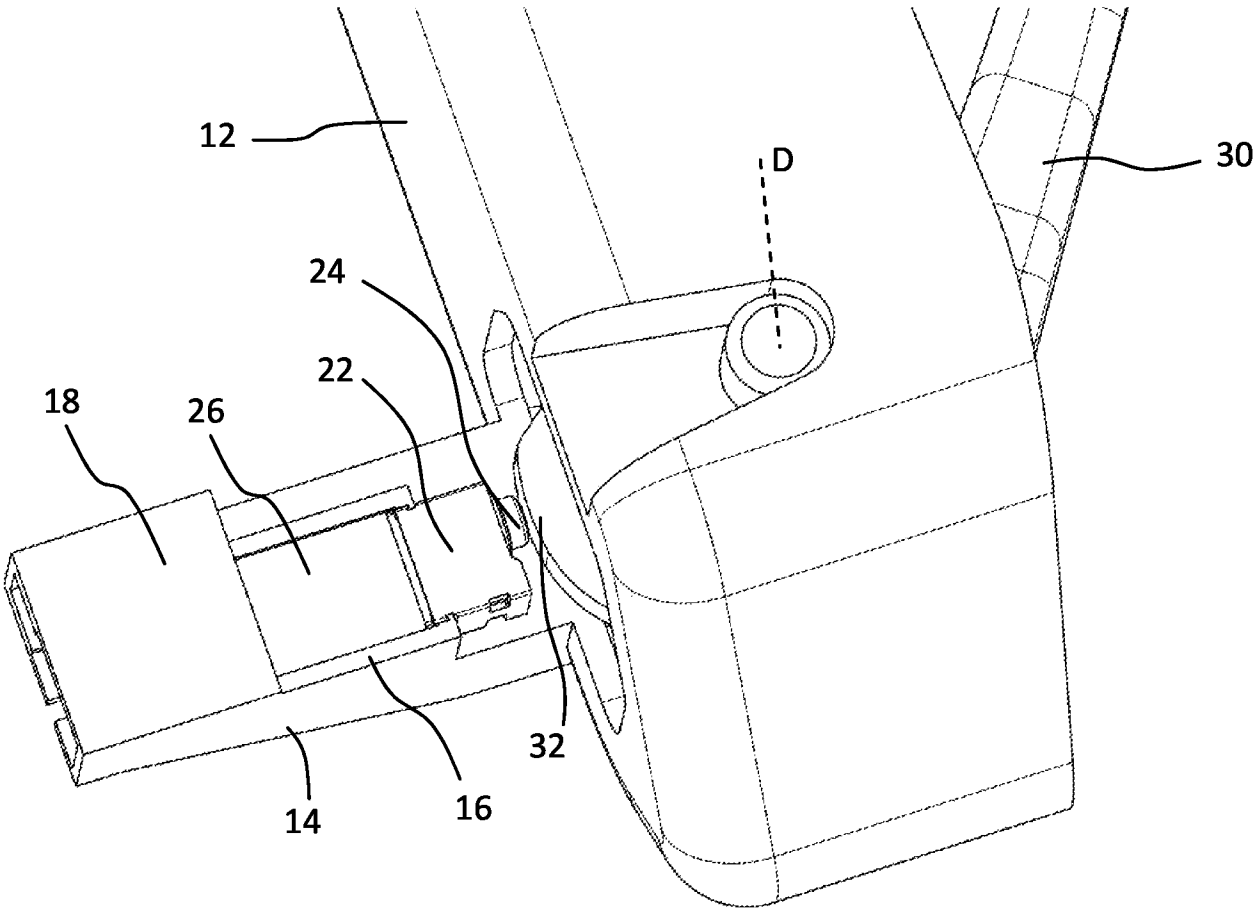
FIG. 8 shows the illustration from FIG. 7 with a deflected door lever.
Figure 9:
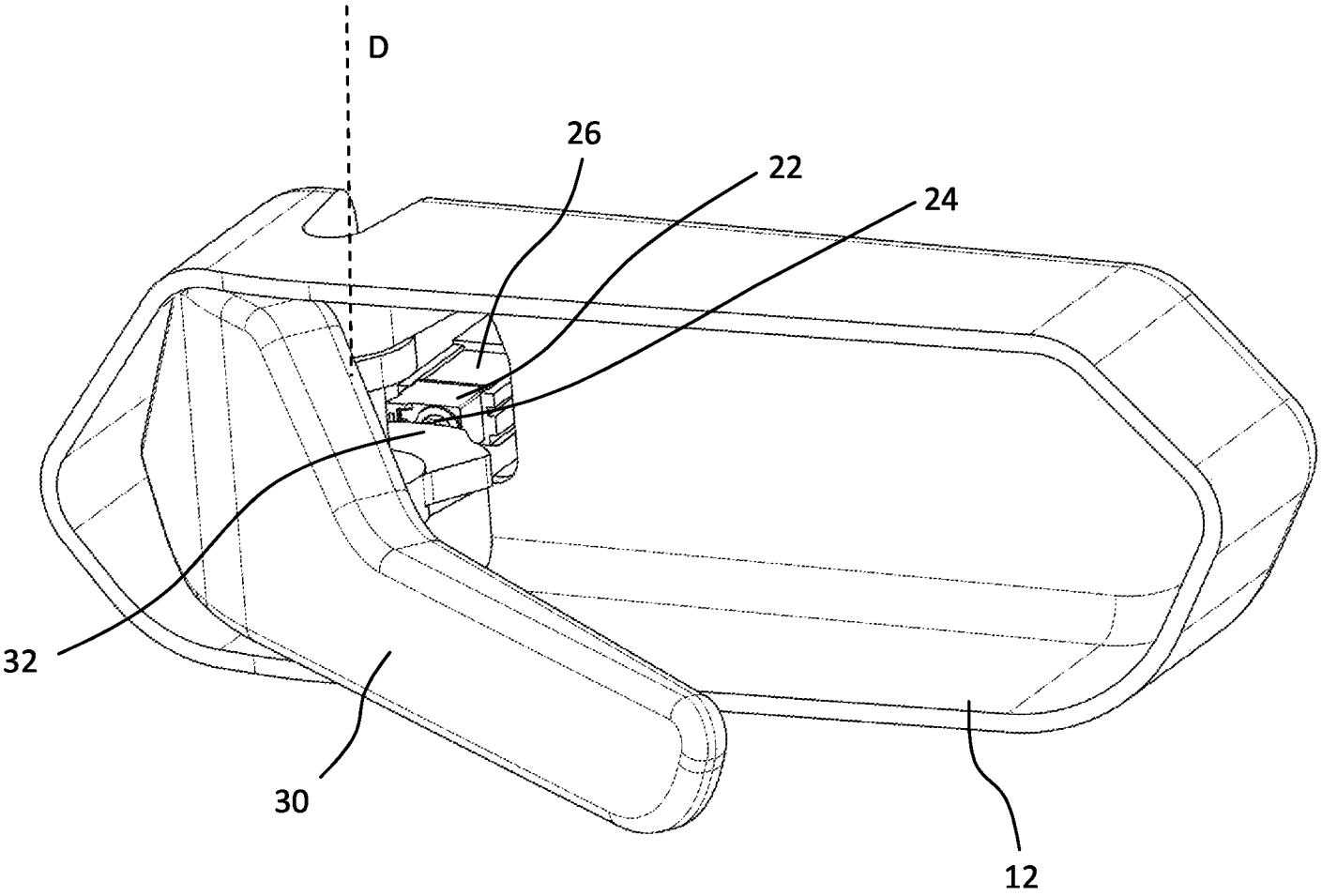
FIG. 9 shows the illustration from FIG. 8 in another view.
Figure 10:
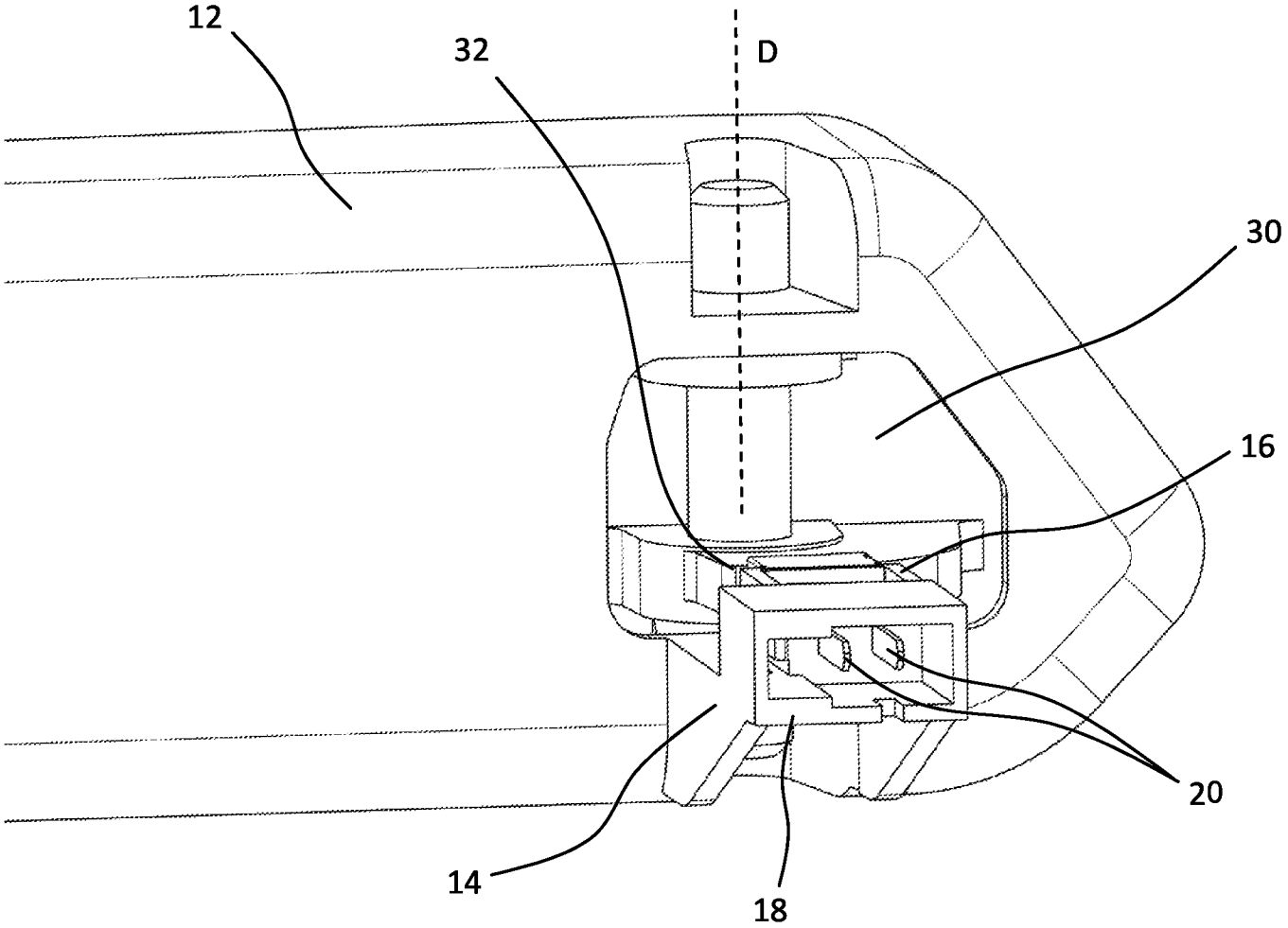
FIG. 10 shows the illustration from FIG. 8 in a further view.

In FIGS. 6 and 7, the door lever 30 is in a non-deflected state. An actuating portion 32 of the door lever 30 consequently does not actuate the switch 22. The switch 22 is thus situated in an open position. As a result of a pivoting of the door lever 30 about its axis of rotation D out of the plug housing 12, as can be seen in FIGS. 8 to 10, the actuating portion 32 of the door lever 30 is adjusted toward the switch 22 and thus pushes the triggering element 24 into the switch 22. In this way, the switch 22 is closed, and an electrical connection between electrical contacts 20 is produced.

Owing to the integral formation according to the invention of the plug housing 14 and of the actuator housing 12 on one another and the subsequent insertion of the switch together with electrical contacts into the plug housing 14, the production of the signal generator is simplified in relation to known signal generators. Owing to the electrical contacts situated in the plug housing, it is furthermore easily possible for an electric drive that is to be connected to the signal generator to be directly mounted onto or inserted into the plug housing.

LIST OF REFERENCE DESIGNATIONS

12 Actuator housing
14 Plug housing
16 Receiving portion
18 Connecting portion
19 Lead frame
20 Electric contacts
21 Transverse webs
22 Switch
23 Output contact lugs
23.1 Clip structure
24 Triggering element
26 Potting compound
30 Door lever
32 Actuating portion

The invention claimed is:

1. A signal generator, for a vehicle door or flap, comprising an actuator which is configured to be manually actuated and/or gripped by an operating person, furthermore comprising a plug housing with a switch which is received therein or arranged thereon and which has electrical contacts which form part of a plug connection, and comprising an actuator housing with the actuator, the actuator being mounted movably on the actuator housing and acting on the switch, wherein the actuator housing and the plug housing are positionally fixed relative to one another, and the electrical contacts are electrically connected to the switch by plugged-in conductors, wherein the actuator comprises a door lever which is mounted pivotably on the actuator housing and which acts on the switch.

2. The signal generator as claimed in claim 1, at least one of the contacts being in one piece and, at one side, forming the contact for the plug connection and, at the other side, being plugged onto the switch by being plugged onto an output contact pin or an output contact lug which projects out of a housing in which the switch is received as a module.

3. The signal generator as claimed in claim 1, wherein the switch has a clip structure as a connection point, and at least one of the electrical contacts is plugged into the clip structure.

4. The signal generator as claimed in claim 1, wherein a potting compound is introduced for sealing the switch in the plug housing.

5. The signal generator as claimed in claim 1, wherein the electrical contacts are portions of a lead frame.

6. The signal generator as claimed in claim 1, wherein the plug housing is configured for direct connection to an electric drive.

7. A system composed of an electric drive and a signal generator as claimed in claim 1, wherein the electric drive is connected directly to the plug housing.

8. The signal generator of claim 1, wherein the door lever is mounted within the actuator housing, wherein the plug housing and switch are located outside of the actuator housing, wherein the actuator housing includes a wall having an opening that aligns with the switch, wherein a portion of the door lever protrudes from the opening to act on the switch when the door lever is pivoted.

9. The signal generator as claimed in claim 1, wherein the plug housing and the actuator housing are formed integrally on one another, and the switch is inserted with the electrical contacts into the plug housing.

10. The signal generator as claimed in claim 9, wherein the plug housing and the actuator housing are formed integrally on one another by injection molding.

11. The signal generator as claimed in claim 9, wherein firstly the actuator housing is produced and subsequently the plug housing is formed integrally onto the actuator housing, or wherein firstly the plug housing is produced and subsequently the actuator housing is formed integrally onto the plug housing.

12. The signal generator as claimed in claim 9, wherein the plug housing and the actuator housing are formed integrally on one another by means of joint production of plug housing and actuator housing as one piece.

13. A method for the production of an opening switch, for a vehicle door, the opening switch having a plug housing, with a switch which is received therein and which has electrical contacts which form part of a plug connection, and having an actuator housing, with an actuator which is mounted movably on the actuator housing and which acts on the switch, wherein the actuator is configured to be manually actuated and/or gripped by an operating person, wherein the actuator comprises a door lever which is mounted pivotably on the actuator housing and which acts on the switch, having the steps:

attaching the plug housing and the actuator housing to one another, inserting the switch with the electrical contacts into or onto the plug housing;

and electrically connecting the electrical contacts to the switch by plugging-in of conductors.

14. The method of claim 13, wherein the door lever is mounted within the actuator housing, wherein the plug housing and switch are located outside of the actuator housing, wherein the actuator housing includes a wall having an opening that aligns with the switch, wherein a portion of the door lever protrudes from the opening to act on the switch when the door lever is pivoted.

15. The method as claimed in claim 13, including introduction of a potting compound into the plug housing for sealing the switch in the plug housing.

16. The method as claimed in claim 13, wherein the electrical contacts are portions of a lead frame, the lead frame being severed to form separate electrical contacts after the insertion of the lead frame into the plug housing.

17. The method as claimed in claim 13, wherein the attachment of the plug housing and the actuator housing to one another is performed by integral formation of the plug housing and of the actuator housing on one another.

18. The method as claimed in claim 17, wherein the plug housing and the actuator housing are integrally formed on one another by injection molding.

19. The method as claimed in claim 17, including:

production of the actuator housing and subsequent integral formation of the plug housing onto the actuator housing, or production of the plug housing and subsequent integral formation of the actuator housing on the plug housing.

20. The method as claimed in claim 17, the plug housing and of the actuator housing are integrally formed on one another by means of joint production of the plug housing and the actuator housing as one piece by injection molding.

* * * * *